US005741127A

United States Patent [19]

Murayama et al.

[11] Patent Number: 5,741,127

[45] Date of Patent: Apr. 21, 1998

[54] VANE FOR VANE COMPRESSOR

[75] Inventors: Toshihiro Murayama; Tadashi Saito, both of Kounan-machi, Japan

[73] Assignee: Zexel Corporation, Tokyo, Japan

[21] Appl. No.: 567,604

[22] Filed: Dec. 5, 1995

[30] Foreign Application Priority Data

Dec. 20, 1994 [JP] Japan ..... 6-334973

[51] Int. Cl.[6] ..... F01C 21/00

[52] U.S. Cl. ..... 418/178; 29/888.015; 29/889.7

[58] Field of Search ..... 418/178, 179, 418/260; 29/888.025, 889.7, 889.71, 465, 505

[56] References Cited

U.S. PATENT DOCUMENTS 5,222,297 6/1993 Graff et al. ..... 29/889.7

5,573,390 11/1996 Takeuchi et al. ..... 418/178

FOREIGN PATENT DOCUMENTS

| | | | |
|---|---|---|---|
| 1-182592 | 1/1989 | Japan . | |
| 73186 | 3/1989 | Japan | 418/178 |
| 136586 | 5/1990 | Japan | 418/178 |
| 6033884 | 2/1994 | Japan | 418/178 |

*Primary Examiner*—Charles G. Freay

*Attorney, Agent, or Firm*—Frishauf, Holtz, Goodman, Langer & Chick

[57] ABSTRACT

A vane for a vane compressor comprises an aluminum based metal and a clad of a ferrous metal provided on the surface of the aluminum base metal. The vane is formed by joining a pipe of the ferrous metal onto the surface of the aluminum based basis pressing process.

17 Claims, 6 Drawing Sheets

VANE FOR VANE COMPRESSOR

BACKGROUND OF THE INVENTION

1. Field of the Invention

This invention relates to a vane for use in a vane compressor and a method of manufacturing the same, and more particularly to a vane of this kind which is reduced in weight and at the same time has improved sliding characteristics, and a method of manufacturing the same.

2. Description of the Prior Art

A vane compressor comprises a cam ring, a front side block and a rear side block closing respective opposite ends of the cam ring, and a rotor rotatably received within the cam ring. The cam ring is formed with vane slits having respective vanes slidably fitted therein. As the rotor rotates, the vanes radially move out of the respective vane skits by a centrifugal force and back pressure acting on the back of each vane, so that the tip of each vane urgingly slides along the inner peripheral surface of the cam ring, thereby compressing refrigerant gas trapped in compression chambers each defined by adjacent vanes.

Aluminum or aluminum alloy (hereinafter both referred to as "aluminum-based metal" or aluminum base metal) is conventionally employed as the material of the cam ring, the rotor, and the vanes, for the sake of light weight, as disclosed e.g. in Japanese Laid-Open Patent Publication (Kokai) No. 1-182592. When the cam ring and the vanes are both formed of an aluminum-based metal, the vanes are often subjected to surface treatment by the use of a nickel-phosphorus based (Ni—P based) material for prevention of adhesion of the vanes to the cam ring, which can be caused by sliding of the vanes on the cam ring.

FIGS. 7A to 7C illustrate a conventional method of manufacturing vanes. First, powdered aluminum ll4*a* is extruded into a shape as shown in FIG. 7A, and then the extruded form 114*a* of aluminum is machined into a shape of a vane as shown in FIG. 7B. Finally, the machined form of aluminum is provided with nickel-phosphorus based plating 114*b* as shown in FIG. 7C.

However, the nickel-phosphorus based plating increases manufacturing cost, and is liable to flaking under specific conditions, resulting in adhesion of vanes to the cam ring or seizure of the former by the latter.

If the whole of a vane is formed of a ferrous metal to overcome the above problem, it is possible to obtain excellent sliding characteristics, but the weight of each vane is increased, which can cause large noise of chattering of vanes. Further, vanes apply large impacts on the cam ring, causing wear of the contacting portions of the associated members.

SUMMARY OF THE INVENTION

It is a first object of the invention to provide a vane for use in a vane compressor which is free from seizure, and can be manufactured without increasing the weight and manufacturing cost thereof.

It is a second object of the invention to provide a method of manufacturing a vane for use in a vane compressor which is free from seizure, without increasing the weight and manufacturing cost thereof.

To attain the first object, according to a first aspect of the invention, there is provided a vane for a vane compressor including a cam ring and a rotor received in the cam ring and formed therein with a vane slit, wherein the vane is slidably inserted in the vane slit for moving out of the vane slit when the rotor rotates such that the tip of the vane urgingly slides along an inner peripheral surface of the cam ring.

The vane of the first aspect of the invention is characterized in that the vane comprises an aluminum based basis metal, and a clad of a ferrous metal provided on a surface of the aluminum based basis metal.

The vane of the first aspect of the invention is distinguished from the conventional type which is formed by providing an Ni—P based plating on the surface of an aluminum based basis metal, in that there does not arise seizure due to flaking of the plating, and that the manufacturing cost is reduced since the clad of the ferrous metal is employed in place of the Ni—P based plating, while preserving excellent sliding characteristics of the vane. Further, compared with vanes the whole of which is formed of a ferrous metal, the vane of the present embodiment is light in weight, and is capable of suppressing noise produced by chattering of the vanes.

Preferably, the aluminum based basis metal has a cavity formed therein.

According to this preferred embodiment, since the aluminum-based basis metal is formed with a cavity, the cavity absorbs a difference in thermal expansion between the aluminum based basis metal and the clad, which prevents the vane from being deformed.

To attain the second object, according to a second aspect of the invention, there is provided a method of manufacturing a vane for a vane compressor, comprising the step of joining a pipe of a ferrous metal onto a surface of an aluminum based basis metal, by a drawing or pressing process.

According to the method of the second aspect of the invention, the pipe of a ferrous metal is joined onto the surface of an aluminum based basis metal by drawing or pressing, which makes it possible to provide the clad of a ferrous metal which can be easily formed, such as soft iron, and use, as a basis metal, an ordinary material, such as an alloy having an alloy number on the order of 6000 (Al—Mg—Si based alloy) or 2000 (Al—Cu based alloy), instead of a powdered aluminum, which contributes to reduction of the manufacturing cost. Further, the above method makes it possible to obtain a shape (near net shape) very close to that of the vane as a final product, which helps to largely reduce the manufacturing cost.

Preferably, the pipe of the ferrous metal is heated up to approximately 200° to 300° C. when the drawing or pressing is carried out.

According to this preferred method, the iron pipe is heated up to a temperature of approximately 200° to 300° C., and then drawn or pressed, so that the iron pipe is firmly joined to the surface of the aluminum-base metal, which prevents the basis metal and the clad from being separated from each other under actual use conditions.

Also to attain the second object, according to a third aspect of the invention, there is provided a method of manufacturing a vane for a vane compressor, comprising the steps of inserting an aluminum-base basis metal in the form of a bar into a pipe of a ferrous metal, heating the pipe of the ferrous metal up to approximately 200° to 300° C., inserting the pipe of the ferrous metal and the aluminum-based basis metal into a hole of a die, and drawing the pipe of the ferrous metal while blowing a cold air thereon.

According to the method of the third aspect of the invention, the iron pipe is heated up to a temperature of approximately 200° to 300° C., and then drawn out, so that the iron pipe is firmly joined to the surface of the aluminum-based metal, while preventing the aluminum base metal and the coating from being separated from each other under actual use conditions.

Preferably, the aluminum base metal is cooled before the aluminum base metal is inserted into the pipe of the ferrous metal.

Also to attain the second object, according to a fourth aspect of the invention, there is provided a method of manufacturing a vane for a vane compressor, comprising the steps of inserting a pipe of a ferrous metal into a hole of a die, heating the pipe of the ferrous metal up to approximately 200° to 300° C., and pressing the aluminum base metal into the pipe of the ferrous metal by means of a punch.

According to the method of the fourth aspect of the invention, the pipe of the ferrous metal is heated up to a temperature of approximately 200° to 300° C., and then the aluminum base metal is pressed therein, so that the pipe of the ferrous metal is firmly joined to the surface of the aluminum base metal, which prevents the aluminum base metal and the clad from being separated from each other under actual use conditions.

Preferably, before the aluminum base metal is inserted into the pipe of the ferrous metal, the aluminum base metal is cooled.

The above and other objects, features and advantages of the present invention will become more apparent from the following description taken in conjunction with the accompanying drawings.

DETAILED DESCRIPTION OF THE PREFERRED EMBODIMENTS

Next, the invention will now be described in detail with reference to drawings showing preferred embodiments thereof.

Figure 2:
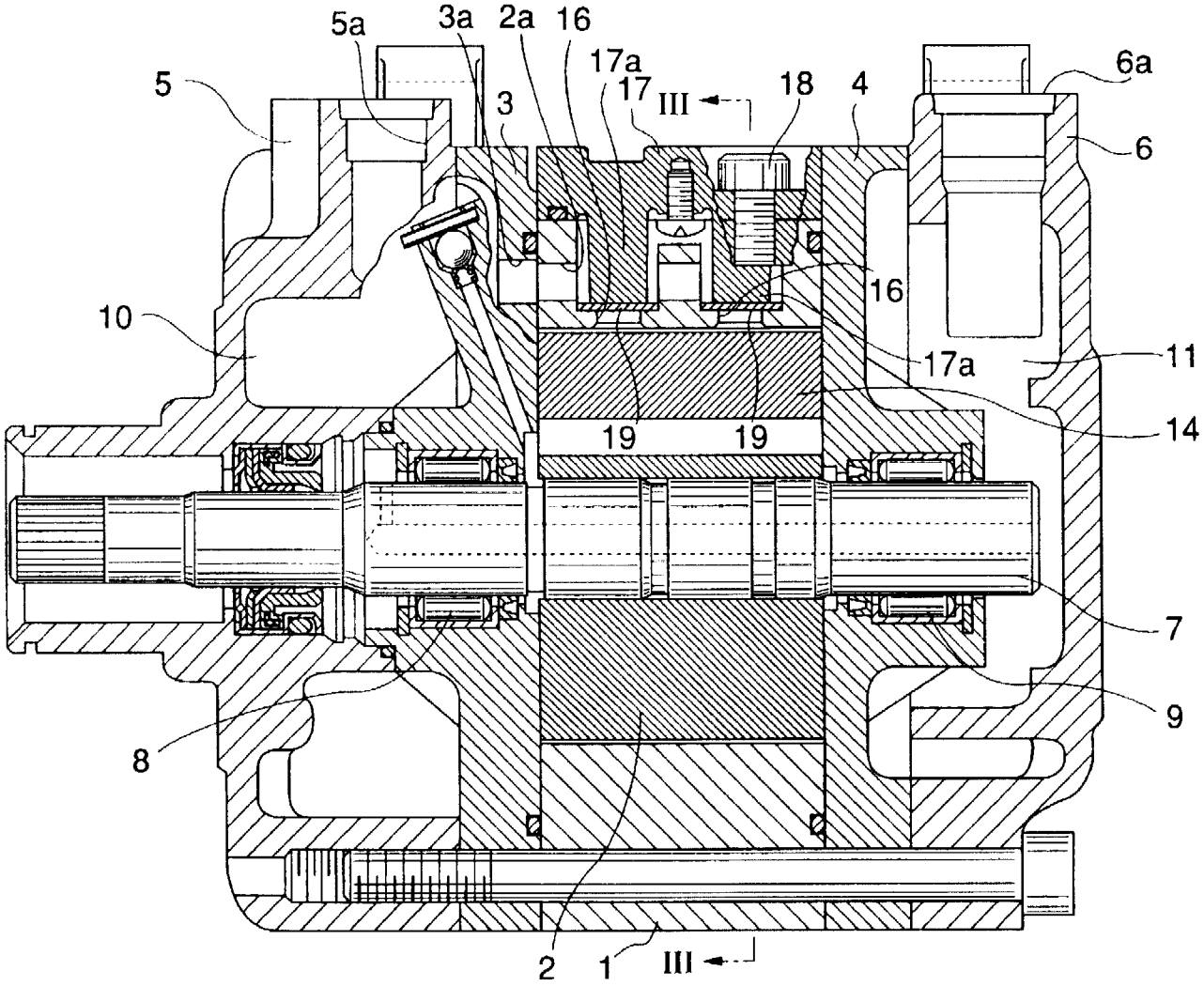
FIG. 2 is a longitudinal cross-sectional view showing the whole arrangement of the vane compressor.
Figure 3:
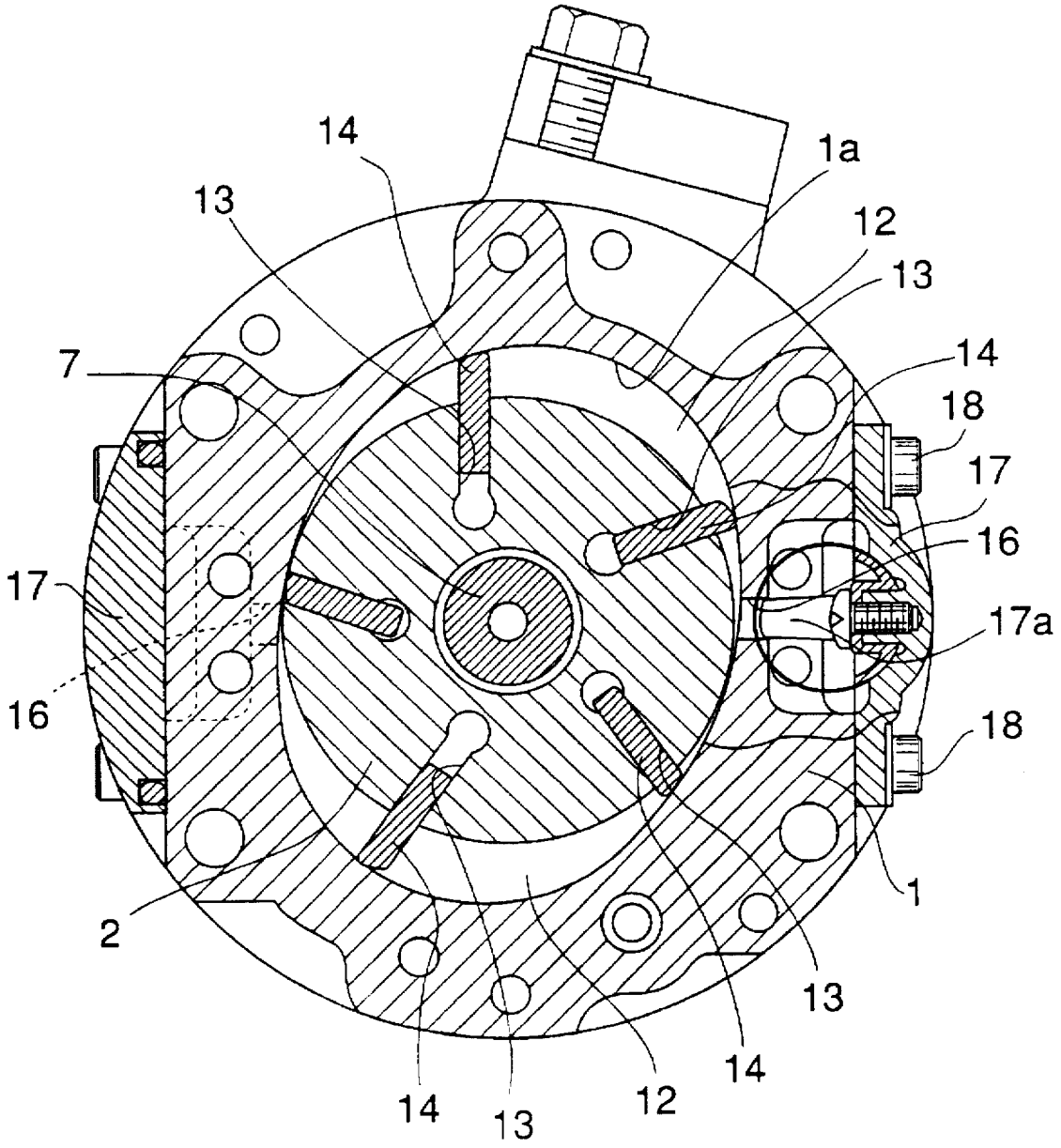
FIG. 3 is a cross-sectional view of the FIG. 2 vane compressor taken on line III—III of FIG. 2.

FIG. 2 shows a sectional view of a vane compressor taken along the longitudinal axis thereof according to one embodiment of the invention. FIG. 3 is a cross-sectional view taken on line III—III of FIG. 2. The vane compressor is comprised of a cam ring 1 , a cylindrical rotor 2 rotatably received within the cam ring 1, a front side block 3 and a rear side block 4 closing open opposite ends of the cam ring 1, a front head 5 and a rear head 6 secured to outer ends of the respective front and rear side blocks 3 and 4, and a driving shaft 7 on which is secured the rotor 2.

The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As best shown in FIG. 3, a pair of compression spaces 12, 12 are defined at diametrically opposite locations between an inner peripheral surface 1*a* of the cam ring 1, and an outer peripheral surface of the rotor 2 (one of the compression chambers is shown in the figure). The rotor 2 has its outer peripheral surface formed therein with a plurality of axial vane slits 13 at cimcumferentially equal intervals, in each off which a vane 14, described in detail hereinbelow, is radially slidably fitted. Each compression space 12 is divided by vanes 14 into compression chambers, the volume of each of which is varied with rotation of the rotor 2.

A pair of refrigerant outlet ports 16, 16 are formed through opposite lateral side walls of the cam ring 1 at diametrically opposite locations (only one 16 of them is shown in FIG. 2). The opposite lateral side walls of the cam ring 1 are provided with two discharge valve covers 17, 17, each formed integrally with a valve stopper 17*a*, and fixed to the cam ring 1 by fixing bolts 18. Discharge valves 19, 19 are mounted between the respective lateral side walls of the cam ring 1 and the valve stoppers 17*a*, 17*a* in such a manner that they are supported by the valve covers 17, 17. When the outlet ports 16, 16 are open, refrigerant gas compressed within the compression chambers is delivered via the ports 16, 16, communication passages 2*a*, 3*a*, the discharge pressure chamber 10 and the discharge port 5*a*.

A pair of refrigerant inlet ports, not shown, are formed in the rear side block 4 at upper and lower locations corresponding to the two compression spaces 12 at upper and lower locations, respectively. The suction chamber 11 is communicated via the inlet ports with the compression spaces 12.

Figure 1:
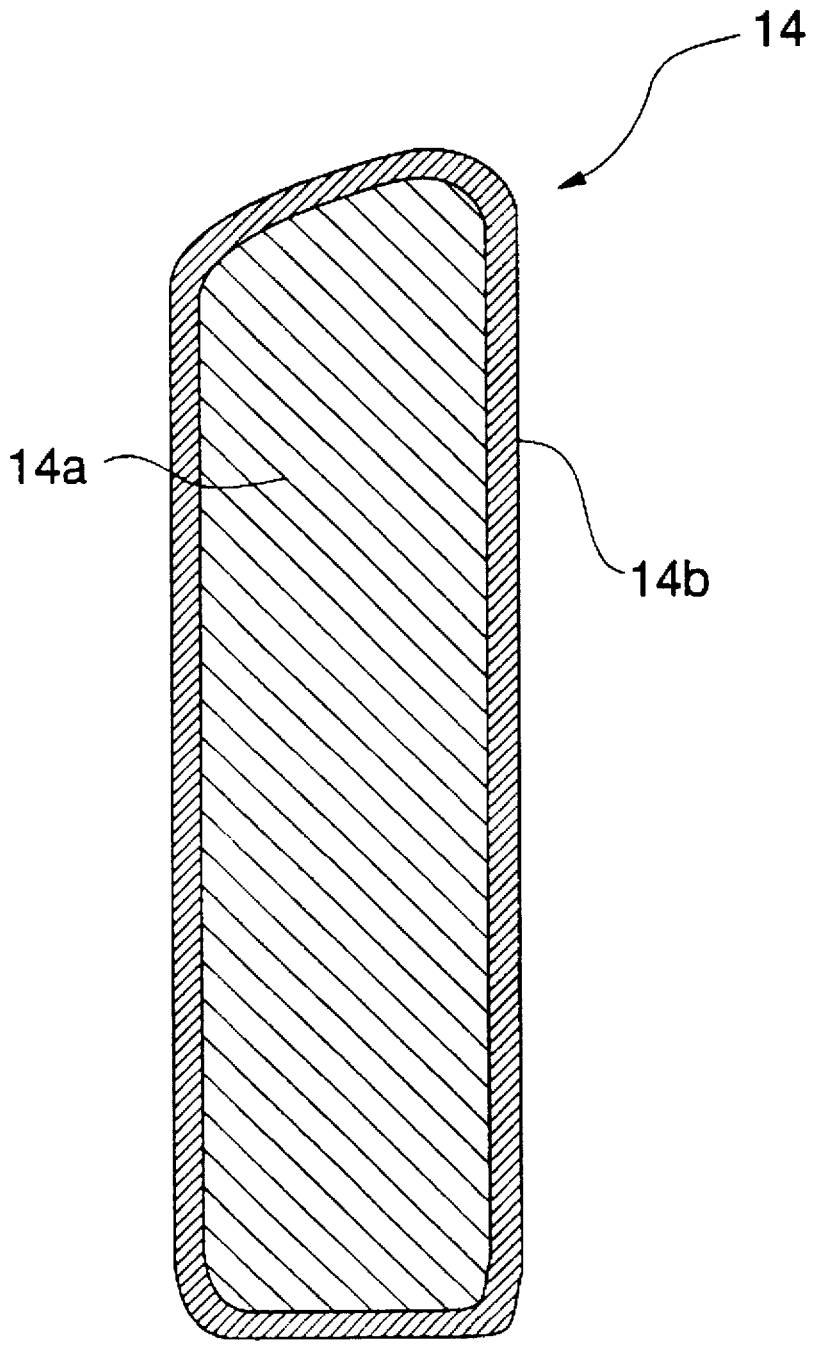
FIG. 1 is a cross-sectional view of a vane for use in a vane compressor according to an embodiment of the invention.
Figure 4:
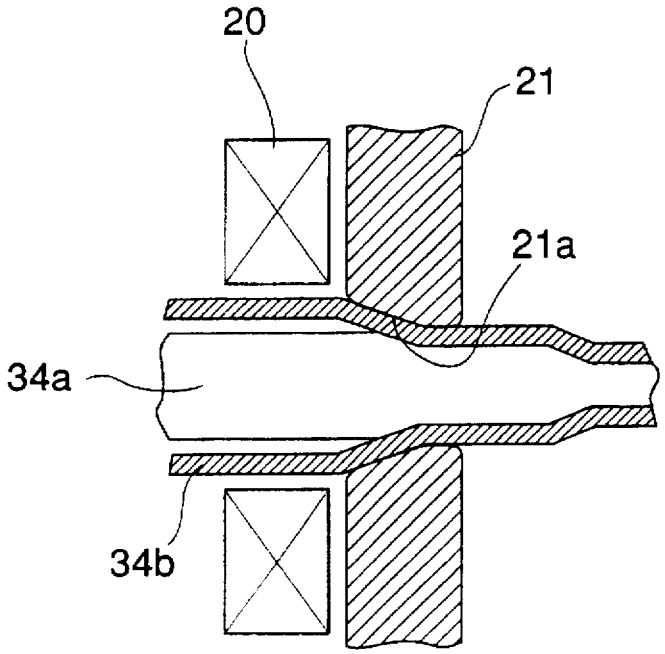
FIG. 4 is a diagram useful in explaining a method of manufacturing the vane shown FIG. 1.
Figure 5:
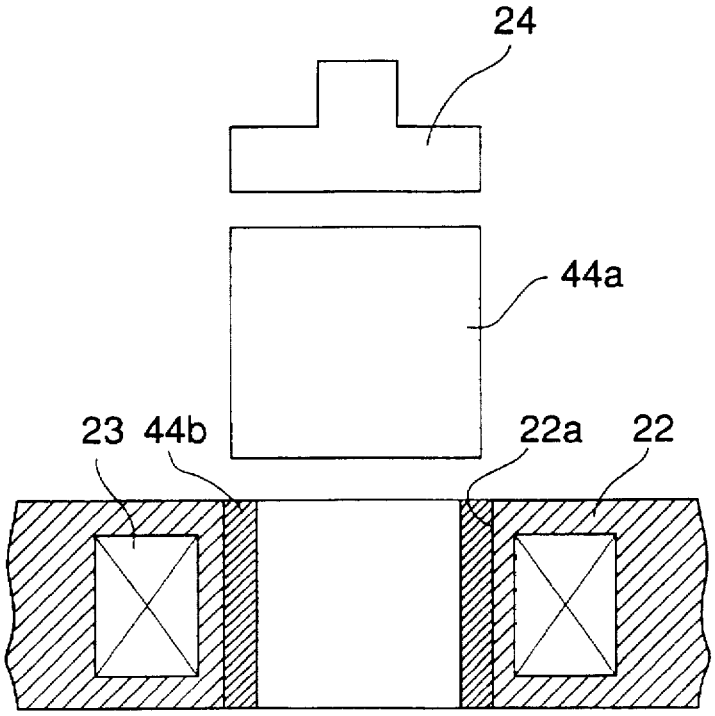
FIG. 5 is a diagram useful in describing another method of manufacturing the vane shown FIG. 1.

FIG. 1 shows one of the vanes on an enlarged scale. FIG. 4 illustrates a method of manufacturing vanes. FIG. 5 illustrates another method of manufacturing vanes.

As shown in FIG. 1, the vane 14 of the present invention is formed of a base metal 14*a* of aluminum or an aluminum alloy (hereinafter referred to as "an aluminum-based metal" or aluminum base metal), and a clad 14*b* of a ferrous metal covering the surface of the aluminum base metal 14*a*.

FIG. 4 shows how the vane 14 is manufactured by a drawing process. A basis metal 34*a* in the form a bar of an aluminum-based metal is inserted into an iron pipe 34*b* which is to form the clad 14*b*. Then, the iron pipe 34*b* and the aluminum base metal 34*a* are inserted into a hole 21*a* (having a cross-section identical to that of the vane) of a die 21, while heating the iron pipe 34*b* alone by a heater 20 up to 200° C. or a higher temperature to thereby expand the same. The iron pipe 34*b* is drawn out together with the aluminum base metal 34*a* while blowing a cold air thereon. Taking actual use conditions (−30° to +200° C.) of the vane into consideration, the aluminum base metal 34*a* may be cooled to −30° C. or a lower temperature before it is inserted into the iron pipe 34*b*.

The aluminum base metal 34*b* cladded with the iron pipe 34*b* is then cut off into shapes of vanes.

FIG. 5 shows another method of manufacturing vanes, which is based on a pressing process. In this manufacturing method, an iron pipe 44b is inserted into a hole 22a of a die 22, and the iron pipe 44b is heated by a heater 23 up to 200° C. or a higher temperature to thereby expand the same. Then, an aluminum base metal 44a is pressed into the iron pipe 44b by means of a punch 24. Before pressing the aluminum base metal 44a into the iron pipe 44b , the aluminum base metal 44a may be cooled to −30° C. or a lower temperature, similarly to the first-described method.

The aluminum base metal 44b cladded with the iron pipe 44b is then cut off into shapes of vanes.

The operation of the variable capacity vane compressor constructed as above will be explained below.

As torque is transmitted from an engine, not shown, to the driving shaft 7, the rotor 2 is driven for rotation. Refrigerant gas flowing out of an outlet port of an evaporator, not shown, is drawn into the suction chamber 11 of the compressor via the suction port 6a thereof. The refrigerant gas is drawn into the compression spaces 12 from the suction chamber 11 via the refrigerant inlet ports. The compression spaces 12 are divided by vanes into compression chambers, each of which is varied in capacity with rotation of the rotor 2, as described above, whereby refrigerant gas trapped in each compression chamber is compressed, and the compressed refrigerant gas opens the discharge valve 19 to flow out via the refrigerant outlet ports 16 into the discharge pressure chamber 10, followed by being discharged via the discharge port 5a.

As the rotor rotates, the vanes 14 radially move out of the respective vane slits 13 by a centrifugal force and back pressure acting on the back of each vane, so that the tip of each vane urgingly slides along the inner peripheral surface 1a of the cam ring 1.

As described above, the vane 14 of the present embodiment is distinguished from the conventional type, which is formed by providing an Ni—P based plating on the surface of an aluminum base metal, in that there does not arise seizure due to flaking of the plating, and that the manufacturing cost is reduced since the clad 14b of the ferrous metal is employed instead of the Ni—P based plating. Further, the vane 14 maintains excellent sliding characteristics.

Further, compared with vanes the whole of which is formed of a ferrous metal, the vane of the present invention is light in weight, and is capable of suppressing noise produced by chattering of vanes.

Further, as described hereinabove, the vanes 14 are formed by a manufacturing method based on drawing process or a pressing process, which makes it possible to provide the clad 14b of a ferrous metal which can be easily shaped, such as soft iron, and employ, as the aluminum base metal 14a, an ordinary material, such as a metal having an alloy number on the order of 6000 (Al—Mg—Si based alloy) or 2000 (Al—Cu based alloy), instead of powdered aluminum, which contributes to reduction of manufacturing cost.

Further, both of the manufacturing methods make it possible to obtain a shape (near net shape) very close to that of a vane as a final product, which helps to largely reduce the manufacturing cost.

Further, in both of the manufacturing methods, the iron pipes 34b , 44b are heated up to 200° C. or a higher temperature for expansion, and then drawn or pressed, so that the iron pipe 34b or 44b is firmly joined to the surface of the aluminum base metal, which prevents the aluminum base metal 14a and the clad 14b from being separated from each other under actual use conditions (−30 to +200° C.).

Figure 6:
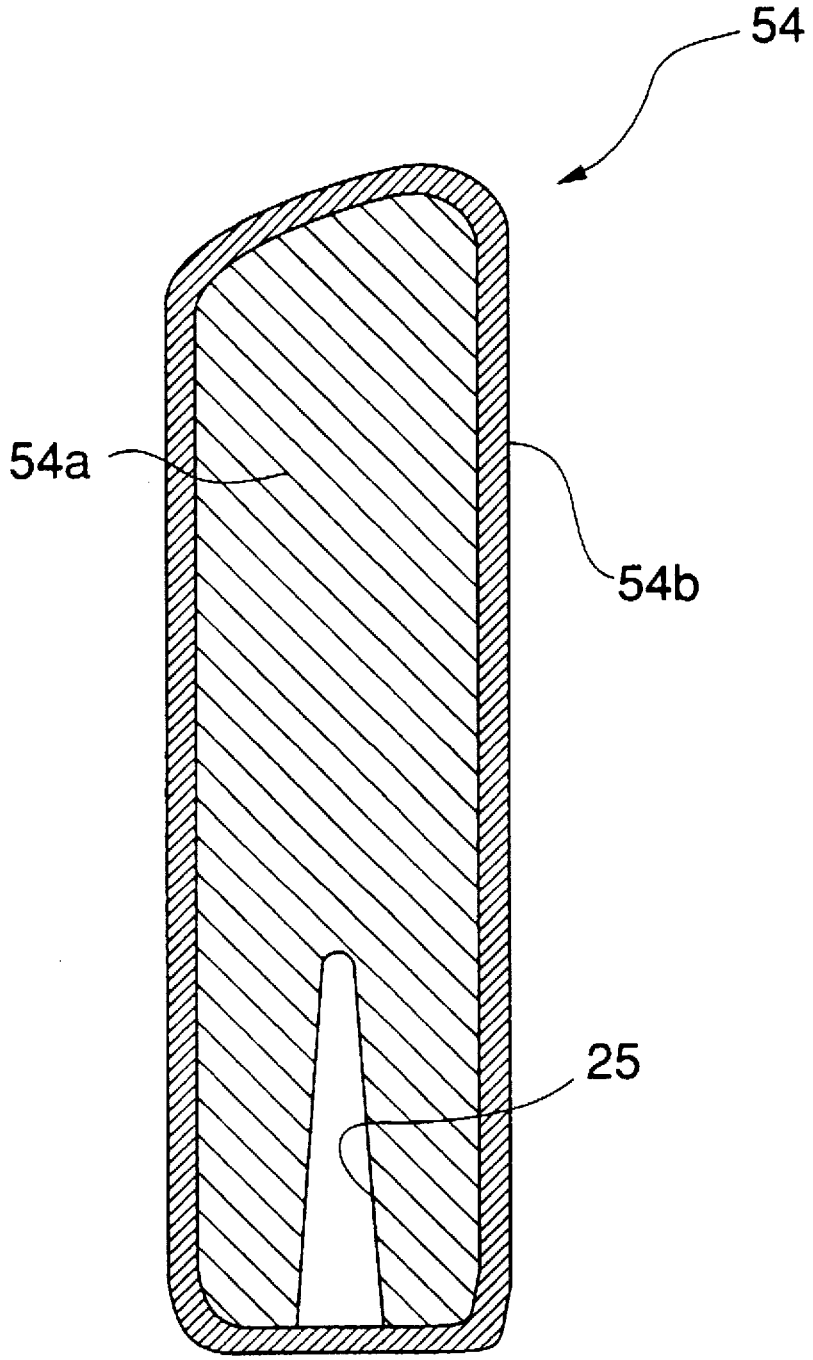
FIG. 6 is a cross-sectional view of a vane for use in a vane compressor according to another embodiment of the invention.
Figure 7A:
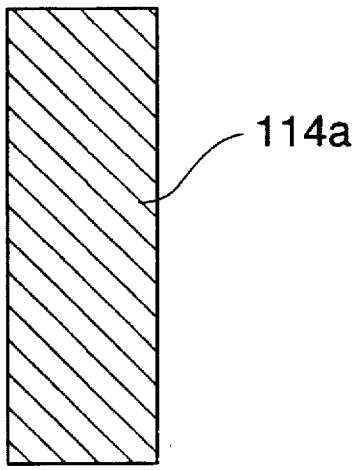
FIG.7A PRIOR ART
FIGS. 7A to 7C are diagrams useful in explaining a conventional method of manufacturing a vane.
Figure 7B:
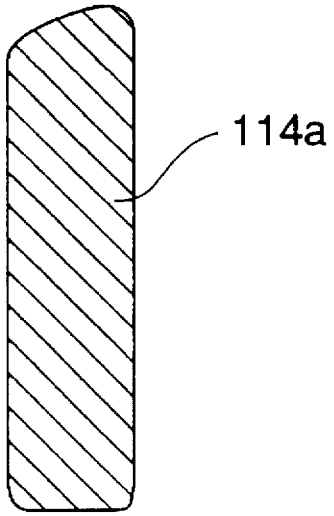
FIG.7B PRIOR ART
Figure 7C:
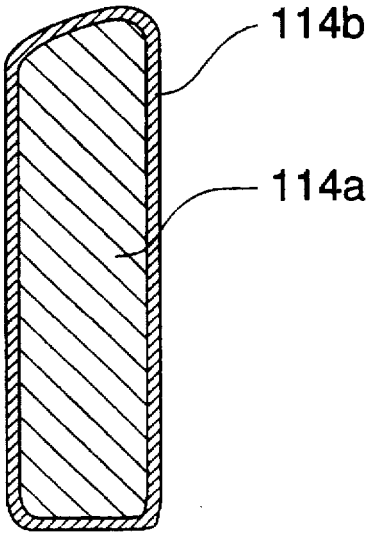
FIG.7C PRIOR ART

FIG. 6 shows a vane 54 according to another embodiment of the invention on an enlarged scale.

This embodiment is distinguished from the first-described embodiment in that, as shown in FIG. 6, an aluminum base metal 54a having a cavity 25 is employed in place of a plate of the aluminum base metal 14a . When the vane 54 of this embodiment is employed, the cavity 25 absorbs a difference in thermal expansion between the aluminum base metal 54a and the clad 54b, which prevents the vane from being deformed.

What is claimed is:

1. A vane for a vane compressor which includes a cam ring and a rotor received in said cam ring, wherein:

said vane is slidably inserted in a vane slit formed in said rotor so as to be movable out of said vane slit when said rotor rotates, such that a tip of said vane urgingly slides along an inner peripheral surface of said cam ring, said vane comprises an aluminum base metal, and a clad of a ferrous metal provided on a surface of said aluminum base metal, and said aluminum base metal has a cavity formed therein.

2. A vane according to claim 1, wherein said cavity is covered by said clad.

3. A vane for a vane compressor which includes a cam ring and a rotor received in said cam ring, wherein:

said vane is slidably inserted in a vane slit formed in said rotor so as to be movable out of said vane slit when said rotor rotates, such that a tip of said vane urgingly slides along an inner peripheral surface of said cam ring, said vane comprises an aluminum base metal, and a clad of a ferrous metal provided on a surface of said aluminum base metal, and said vane comprises a pipe of said ferrous metal joined onto said surface of said aluminum base metal.

4. A vane according to claim 3, wherein said aluminum-based aluminum base metal has a cavity formed therein.

5. A vane according to claim 4, wherein said cavity is covered by said clad.

6. A vane according to claim 3, wherein said vane comprises said pipe of said ferrous metal joined onto said surface of said aluminum base metal by a drawing process.

7. A vane according to claim 6, wherein said aluminum base metal has a cavity formed therein.

8. A vane according to claim 7, wherein said cavity is covered by said clad.

9. A vane according to claim 3, wherein said vane comprises said pipe of said ferrous metal joined onto said surface of said aluminum base metal by a pressing process.

10. A vane according to claim 9, wherein said aluminum base metal has a cavity formed therein.

11. A vane according to claim 10, wherein said cavity is covered by said clad.

12. A method of manufacturing a vane for a vane compressor, which includes a cam ring and a rotor received in said cam ring, said vane being slidably inserted in a vane slit formed in said rotor so as to be movable out of said vane slit when said rotor rotates, such that a tip of said vane urgingly slides along an inner peripheral surface of said cam ring, said vane comprising an aluminum base metal, and a clad of a ferrous metal provided on a surface of said aluminum base metal, and said method comprising a step of joining a pipe of said ferrous metal onto said surface of said aluminum base metal by one of drawing and pressing.

13. A method according to claim 3, wherein said pipe of said ferrous metal is heated up to approximately 200° to 300° C. when said drawing or pressing is carried out.

14. A method according to claim 12, wherein said step of joining said pipe of said ferrous metal onto said surface of said aluminum base metal comprises:

inserting said aluminum base metal in a bar form into said pipe of said ferrous metal, heating said pipe of said ferrous metal up to approximately 200° to 300° C., inserting said pipe of said ferrous metal and said aluminum base metal into a hole of a die, and drawing said pipe of said ferrous metal while blowing cold air therein.

15. A method according to claim 14, wherein said aluminum base metal is cooled before said aluminum base metal is inserted into said pipe of said ferrous metal.

16. A method according to claim 12, wherein said step of joining said pipe of said ferrous metal onto said surface of said aluminum base metal comprises:

inserting said pipe of said ferrous metal into a hole of a die, heating said pipe of said ferrous metal up to approximately 200° to 300° C., and pressing said aluminum base metal into said pipe of said ferrous metal by means of a punch.

17. A method according to claim 16, wherein before said aluminum base metal is inserted into said pipe of said ferrous metal, said aluminum base metal is cooled.

* * * * *